United States Patent [19]

Carman

[11] 4,097,306

[45] Jun. 27, 1978

[54] METHOD OF CLEANING SWARF

[75] Inventor: Lyle Carman, Mason, Ohio

[73] Assignee: Prab Conveyors, Inc., Kalamazoo, Mich.

[21] Appl. No.: 712,498

[22] Filed: Aug. 9, 1976

[51] Int. Cl.[2] ..... B08B 3/08; B08B 7/04

[52] U.S. Cl. ..... 134/10; 134/21; 134/25 R; 134/29; 134/30; 134/40; 210/60; 210/73 W

[58] Field of Search ..... 134/10, 21, 25 R, 29, 134/30, 40; 210/43, 60, 73 W

[56] References Cited

U.S. PATENT DOCUMENTS

| | | | |
|---|---|---|---|
| 1,743,466 | 1/1930 | Maag et al. | 134/10 |
| 2,711,978 | 6/1955 | Groom | 134/10 |
| 3,809,575 | 5/1974 | Yeo | 134/21 |
| 3,930,879 | 1/1976 | Erickson et al. | 134/25 R X |
| 3,954,611 | 5/1976 | Reedy | 210/73 W X |
| 3,997,359 | 12/1976 | Dankoff et al. | 134/10 |
| 4,002,562 | 1/1977 | Ames et al. | 210/43 X |

OTHER PUBLICATIONS

Schwartz et al., Surface Active Agents and Detergents, vol. II, pp. 580–585, 1958.

*Primary Examiner*—Richard V. Fisher
*Attorney, Agent, or Firm*—Dressler, Goldsmith, Clement, Gordon & Shore, Ltd.

[57] ABSTRACT

Cutting fluid residues are removed from swarf such as turnings, borings, mill scale, grinding sludge, and the like, by washing the swarf with an aqueous detergent solution so as to emulsify the residues, thereafter removing the emulsified residues by entrainment in fluid stream, and then drying the swarf. If desired, the aqueous detergent solution can be reclaimed for further use by physically separating the emulsified residues therefrom.

21 Claims, 1 Drawing Figure

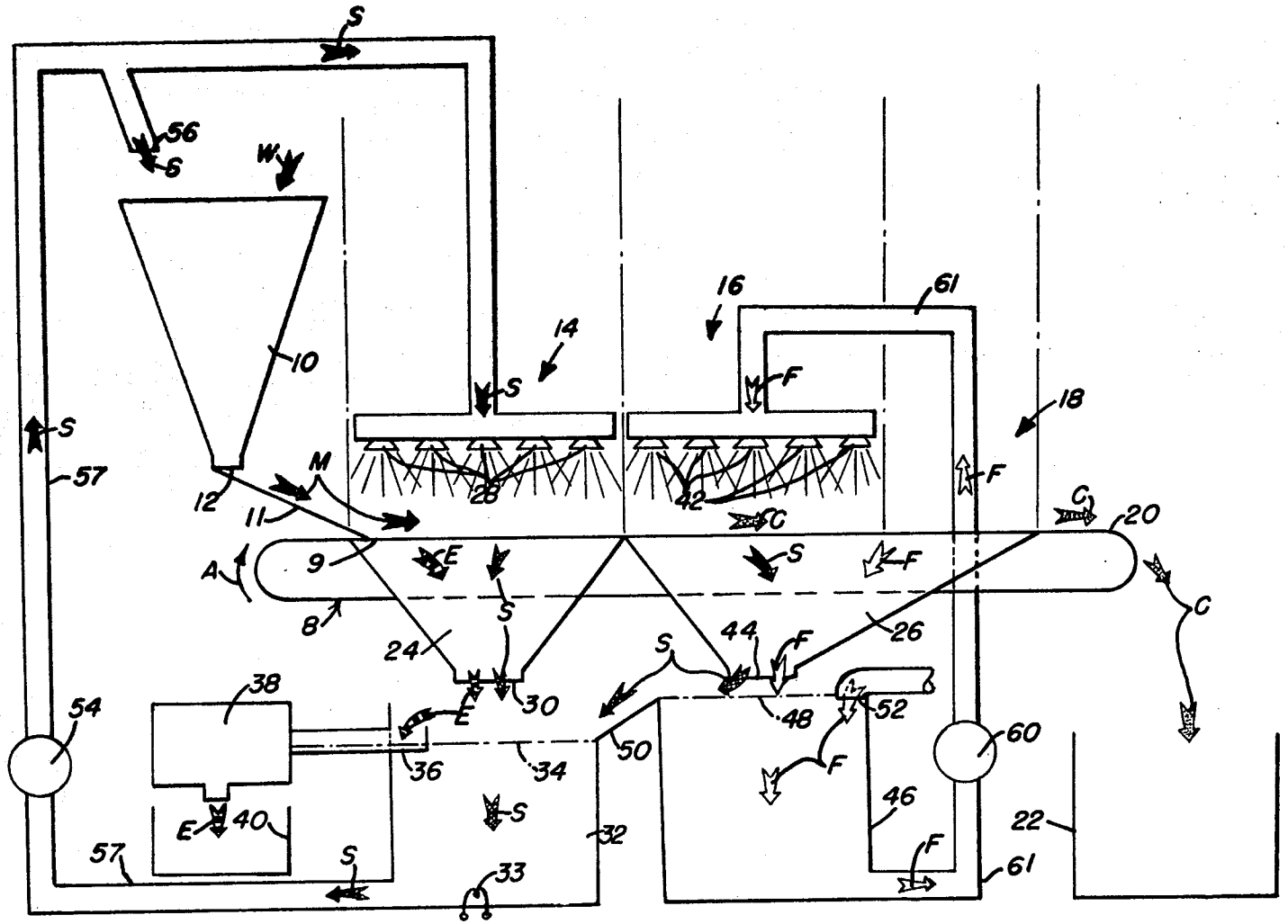
C
20
18
22
60
61
F
26
52
46
48
44
16
42
S
50
32
14
30
34
33
28
E
36
24
9
8
M
10
W
11
12
A
38
40
56
6
57
54

METHOD OF CLEANING SWARF

BACKGROUND OF THE INVENTION

The present invention is directed to a method for removing cutting lubricant residues from swarf such as turnings, borings, mill scales, grinding sludge, and the like.

Machining operations such as metal cutting, grinding, or the like, generate a considerable quantity of waste in the form of chips, turnings, borings, grinding by-products, etc., which are generally referred to as swarf. A cutting fluid, i.e., a liquid coolant/lubricant, is usually employed in conjunction with the machining operation and some of the cutting fluid gets mixed with the swarf generated during machining. The commonly employed cutting fluids are oleaginous substances, e.g., oils, or aqueous emulsions of an oleaginous substance which has been derived from a natural or synthetic source. Most common are aqueous mineral oil emulsions with or without certain proprietary additives. While a major portion of the cutting fluid can be recovered from the swarf by conventional solids-liquids separation procedures such as filtration and centrifugation, a certain amount of cutting fluid residues remains with the swarf.

Swarf itself is a valuable source of raw material which can be reprocessed if available in a relatively pure form. For example, metal turnings, borings, mill scale, and the like, can be compressed into briquettes suitable for charging a metal melting furnace. However, for such utilization the swarf should have a residual oil and moisture content of less than about four percent by weight and preferably less than about two percent by weight. It is very difficult, if not impossible, to attain such low residual oil and moisture levels on a practical scale utilizing filtration and centrifugation methods.

Particulate waste metal can be cleaned by burning off the residual oleaginous substances and simultaneously evaporating the moisture in rotary furnaces or dryers of the type illustrated in U.S. Pat. No. 3,619,908 to Kallas and U.S. Pat. No. 3,767,179 and No. 3,839,086 to Larson, provided the particulate metal can withstand the furnace temperatures and atmosphere.

It is known to remove petroleum based films from metal surfaces by subjecting the metal surfaces to a series of cleansing operations, as shown, by way of example, in U.S. Pat. No. 2,153,577, No. 2,926,674, No. 2,966,914, No. Re. 25,486, No. 3,639,172, No. 3,676,105, No. 3,718,147, No. 3,734,776, No. 3,846,173, and No. 3,865,629.

In particular, U.S. Pat. No. 3,865,629 to Dankoff et al. discloses a process for the recovery of the components of grinding swarf, wherein the swarf is screened and thereafter immersed in and thoroughly mixed with a solvent for washing the coolant therefrom, after which the solvent and water are filtered from the swarf. The bulk solution is then thoroughly mixed and washed with solvent to remove grease and lubricant, and then filtered and subjected to volatilization at elevated temperature to remove any remaining trace of solvent.

U.S. Pat. No. 3,846,173 to Ihrig, U.S. Pat. No. 3,544,369 to Keogh, Jr., U.S. Pat. No. 3,639,172 to Keogh, Jr., and U.S. Pat. No. 3,734,776 to Keogh, Jr. disclose methods of removing oil from oil-laden metal waste such as turnings, chips, and the like by counter-current processing of the metal waste through a wash bath where the metal waste is transported in one direction while a detergent solution is directed in the opposite direction. In these methods, the metal waste is completely submerged in the bath and is lifted therefrom by means of a screw conveyor.

U.S. Pat. No. 3,718,147 to Laroche discloses a method wherein articles to be degreased are advanced through a condensation chamber and a spraying chamber both filled with a solvent heated to its boiling point. When the boiling point is reached, the solvent is discharged and atomized by spray heads, and solvent vapor condenses on the articles to be cleaned as the articles pass through the chambers. The high temperature of the articles causes rapid evaporation of the solvent, whereby the articles leave the chambers dry.

U.S. Pat. No. 2,153,577 to Levine discloses a three-chamber degreasing process wherein articles to be cleansed are immersed in a grease solvent contained in a series of chambers so as to remove the grease present on the surface of the articles, after which the articles are subjected to a vapor rinse.

U.S. Pat. No. Re. 25,486 to Nolte, U.S. Pat. No. 2,966,914 to Sadwith, and U.S. Pat. No. 2,926,674 to Umbricht et al. disclose machines for cleaning and drying pans or the like, wherein the pans are advanced through a series of spray baths and then dried.

The methods taught by the aforementioned patents are clearly distinguishable from the method of the present invention.

SUMMARY OF THE INVENTION

The present invention provides a method for removing cutting fluid residues from particulate swarf by means of detergent solution which emulsifies the residues and a fluid stream (e.g., air, water, or both) which passes through the swarf and removes the emulsified residues from the swarf.

The present method contemplates the steps of contacting particulate swarf with an aqueous detergent, preferably non-ionic detergent, solution to form a swarf-detergent solution admixture and to emulsify the cutting fluid residues present on the swarf, forming a bed of swarf bearing the emulsified residues, and removing the residues from the swarf by subjecting the swarf bed to a fluid stream, preferably an air stream, which passes through the bed at a rate sufficient to entrain therein the residues and to cleanse the swarf. Thereafter the cleansed swarf is recovered for future utilization.

In a preferred embodiment, the admixture of swarf and detergent solution is introduced onto a continuously advancing conveyor having a foraminous belt, e.g., of the type having a mesh sufficient to retain the desired metal components of the mixture while permitting transport of the liquid components of the mixture therethrough. The conveyor advances the admixture through a wash station wherein additional detergent solution is introduced onto the swarf by means of spray showers for further breaking down and washing of the cutting fluid residues from the surface of the swarf particles, a rinse station wherein water is introduced onto the swarf by means of spray showers for removing detergent and emulsified residues from the surface of the metal components of the swarf, and optionally a drying station wherein any remaining traces of water, detergent and emulsified residues are removed from the swarf. The cleansed, dry swarf is then discharged from the conveyor and collected for subsequent use.

Vacuum chambers generating a sub-atmospheric pressure are associated with the wash station and the rinse station and have an intake adjacent the lower surface of the conveyor for assisting drainage of liquid products from the swarf. The vacuum chambers collect and discharge the liquid products, containing oleaginous and aqueous constituents, into associated storage receptacles in which, due to the difference in the specific gravities of the oleaginous and the aqueous constituents, the liquid products undergo phase separation and the oleaginous phase rises to the surface and may be removed therefrom by skimming action. If desired, the skimmed fraction can be centrifuged, to separate any remaining traces of aqueous components therefrom, after which the reclaimed oleaginous phase is collected for subsequent use.

The storage receptacle associated with the wash station can be part of a closed recirculating system from which the recovered aqueous fraction can be recirculated to the wash station spray showers. Similarly, the storage receptacle associated with the rinse station can be part of a closed recirculating system, from which the rinse water collected in the receptacle can be recirculated to the rinse station spray showers.

The drying station may include means for inducing evaporation by passing warmed dry air over and/or through the cleansed swarf. In such a case, the intake of the vacuum chamber for the rinse station is disposed in communication with that portion of the conveyor which is in the drying station so that any remaining traces of rinse water, detergent solution and emulsified cutting fluid can be collected. Alternatively, the drying station can have a radiant heat source which evaporates any moisture that may be present on the cleansed swarf.

BRIEF DESCRIPTION OF THE DRAWING

The FIGURE accompanying this specification is a diagrammatic illustration of the steps in a method which embodies the present invention.

DESCRIPTION OF THE PREFERRED EMBODIMENTS

Referring to the FIGURE, a quantity of swarf W which can be scrap metal components such as turnings, borings, grinding sludge, mill scale or the like bearing cutting fluid residues or similar lubricant/coolant emulsions is introduced into crusher 10 for comminution. Swarf W is suitably admixed with an aqueous detergent solution having active ingredients capable of emulsifying the cutting fluid residues which are present on the surface of the swarf particles. The produced admixture M comprising particulate swarf and the detergent solution is then introduced at loading point 9 onto an endless conveyor 8 having a foraminous belt.

In a preferred embodiment, swarf W and detergent solution S are simultaneously introduced into a conventional crusher 10 wherein the swarf is reduced in bulk for convenience of processing. Any of the crusher apparatus well known in the art may be utilized. Uniformly satisfactory results have been achieved with a crusher of the type having a tapered configuration and terminating in bottom outlet 12 through which admixture M, comprising swarf and detergent, is discharged onto a transfer mechanism 11, such as a vibratory feed conveyor, which then transfers the admixture to loading point 9 on conveyor 8. The action of the crusher assists in forming the desired admixture. The continuous travel of the foraminous conveyor belt as admixture M is deposited on the belt at loading point 9 forms a bed of particulate swarf thereon. The detergent solution that is present emulsifies the cooling fluid residues carried by the particulate swarf and an air stream passed through the thickness of the bed removes the emulsified residues E therefrom.

Of course, various other apparatus may be utilized for comminuting the swarf and/or for admixing swarf W with detergent solution S without departing from the method taught by the present invention. Also, various other operations may be performed intermediate of crusher 10 and conveyor 8 without departing from the present invention. For example, the swarf can be comminuted first and the admixture formed after the crushed swarf is discharged from the crusher. Broadly speaking, the present invention contemplates as the initial step the mixing of particulate swarf with a suitable detergent solution S to emulsify the cutting fluid residues carried by the swarf. The apparatus utilized for performing this step is not, per se, considered to be novel.

To emulsify the cutting fluid residues carried by the swarf, preferably an aqueous non-ionic detergent solution is utilized; however, a solution of an anionic detergent alone or in combination with a non-ionic detergent can also be used, as well as a solution of a cationic detergent alone or in combination with a non-ionic detergent. Preferably the non-ionic detergents that are present are biodegradable so as to minimize ultimate disposal problems. Also, an alkaline solution, generally having a pH greater than 7, preferably about 11 to 11.5, is desired. The detergent is present in the solution in an amount sufficient to emulsify the cutting fluid residues that are present, i.e., sufficient to provide a critical micelle concentration in the solution. The exact detergent concentration in any given instance depends on the amount and nature of the residues that are present on the swarf, process temperature, etc. For a typical metal swarf cleaning process, the detergent concentration in the solution can be about 1 weight percent to about 5 weight percent. Likewise, the swarf/detergent solution weight ratio for any given application can vary depending on the amount and type of residue that is present, the detergent concentration, the oil content of the residue, and similar factors.

For the purposes of the method of the present invention, very effective are balanced combinations of non-ionic detergents, in particular combinations where at least one detergent is water-soluble and at least one detergent is oil-soluble. The relative amounts of each type of detergent that can be present depend on how much oleaginous material is present in the swarf. In general, the weight ratio of water-soluble detergent to oil-soluble detergent can be in the range of about 9:1 to about 1:9, respectively.

The non-ionic detergents in the detergent solutions suitable for practicing the present invention can be the alkoxylated alkyl phenols, i.e., the condensation products of an alkyl phenol containing about 9 to about 19 carbon atoms in the alkyl chain thereof with an alkylene oxide such as ethylene oxide, propylene oxide, and the like. Whether a particular detergent is oil-soluble or water-soluble depends on the average degree of alkoxylation of the alkyl phenol. In general, alkyl phenols containing about 3 moles of alkylene oxide, or less, per mole of alkyl phenol are oil-soluble, and alkyl phenols containing 5 or more moles of alkylene oxide per mole of alkyl phenol are water-soluble.

Preferred alkyl phenol-based non-ionic detergents are the condensation products of nonyl phenol and ethylene oxide having the general formula

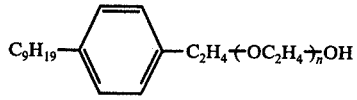

where the amount of ethylene oxide present varies with the value of *n*. Thus, when *n* has an average value of about 4, about 50 weight percent of ethylene oxide is present, and when *n* has an average value of about 11, about 70 weight percent of ethylene oxide is present. Particularly preferred are mixtures of watersoluble ethoxylated nonyl phenols containing about 15 moles of ethylene oxide per mole of nonyl phenol with oil-soluble ethoxylated nonyl phenols containing about 1.5 moles of ethylene oxide per mole of nonyl phenol.

In some instances it may also be advantageous to incorporate into the detergent solutions a small amount of a water-soluble synthetic anionic organic detergent such as the water-soluble alkyl aryl sulfonates having alkyl chains of about 9 to about 19 carbon atoms.

Illustrative cationic organic detergents suitable for the present purposes are ammonia derivatives having an alkyl hydrophobe such as tallow trimethylammonium chloride, and the like.

Preferred biodegradable non-ionic detergents are alkoxylated aliphatic alcohols or polyols containing about 14 to about 30, preferably 14 to about 18 carbon atoms in the aliphatic chain. The alkyleneoxy units per mole of the alcohol or polyol can vary from about 1 to about 17, depending on whether a water-soluble or an oil-soluble detergent is needed. Particularly preferred are the ethoxylated $C_{14}$–$C_{15}$ primary alcohols and mixtures thereof.

To further enhance the emulsifying and detergent action of the aqueous solution and to render the solution alkaline in the desired pH range, certain other additives are dissolved therein. In particular, it has been found that the addition of water-soluble alkali metal salts and/or sequestrants to the solution enhances the swarf cleaning action.

Preferred additives are:

| | Parts by Weight |
|---|---|
| sodium carbonate | about 1 to about 45 |
| sodium meta-silicate | about 1 to about 45 |
| sodium gluconate | about 1 to about 8 |

Optionally, about 0.5 to about 1.5 parts by weight of a defoaming agent, such as a long chain fatty acid or an alkylene oxidetriglyceride adduct, can be added. The foregoing additives are combined with about 1 to about 5 parts by weight of a non-ionic detergent, preferably a mixture of an ethoxylated nonyl phenol containing about 15 moles of ethylene oxide per mole of nonyl phenol and an ethoxylated nonyl phenol containing about 1.5 moles of ethylene oxide per mole of nonyl phenol to produce a dry detergent mix. To form the desired detergent solution about 1 to about 5 ounces of the mix are dissolved in a gallon of water.

Aqueous detergent solutions containing the foregoing additives are pH-sensitive, which property can be advantageously utilized for separating entrained oleaginous materials therefrom so as to regenerate the detergent solutions prior to recycling. For example, in use a circulating detergent solution having an initial pH of about 11 to about 11.5 dissolves carbon dioxide from ambient atmosphere and becomes more acidic. The relatively lower pH value causes any emulsified oleaginous materials that may be present to separate out as a distinct, individually recoverable phase. By permitting such separation in a storage or holding vessel, the inherently relatively lighter oleaginous phase can be easily skimmed off the top portion of the vessel while the relatively heavier aqueous phase comprised mainly of the aqueous detergent solution can be withdrawn from the vessel at a relatively lower level and recirculated for further use.

Additionally, the detergent solutions are temperature sensitive so that an adjustment in the temperature of the solution can bring about phase separation. For example, a detergent solution at substantially ambient temperature can be passed through the swarf bed to emulsify the cutting fluid residues and to provide a liquid product which can thereafter be heated about 20° F. to effect separation of oleaginous materials therefrom for easy recovery.

To clean the swarf, the bed of detergent-treatment admixture M is transported sequentially by the conveyor in the direction of arrow A through wash station 14, rinse station 16, and drying station 18. Thereafter the cleansed, dry swarf C is discharged from the conveyor at discharge end 20 and is collected in a suitable receptacle 22 for subsequent use.

The endless foraminous belt of conveyor 8 can be a filter cloth or a wire mesh having a gauge of sufficient size to support the smallest of the swarf particles while permitting drainage of the obtained liquid product therethrough. The belt passes over a pair of vacuum chambers 24 and 26 which have an upper open end immediately adjacent to the belt for drawing the liquid products, i.e., the detergent solution together with entrained emulsified cutting fluid residues, through the swarf bed on the belt in the thickness direction thereof and through the belt as the conveyor advances the swarf bed from loading point 9 to discharge end 20. In a typical operation, a vacuum of about 20 inches of mercury is maintained in vacuum chambers 24 and 26. Thus, the bed of swarf-detergent solution admixture is continuously subjected to a fluid stream passing through the thickness of the bed by virtue of the vacuum filter system comprising the foraminous belt and the vacuum chambers as the bed passes through wash station 14, rinse station 16, and optional drying station 18. The present swarf cleansing or washing method can be practiced utilizing a horizontal belt vacuum filter of the type commercially available from Straight Line Filters, Inc. of Wilmington, Del.

As conveyor 8 advances admixture M through wash station 14, additional detergent solution S e.g., an aqueous non-ionic detergent solution is introduced by means of a series of spray shower heads 28. The detergent thus introduced further emulsifies the cutting fluid residues present on the surface of the particulate swarf. The emulsified cutting fluid residues are entrained in the detergent solution and the air stream passing through the conveyor belt concurrently with the detergent solution, are transported downwardly through the belt, are collected in vacuum chamber 24, and then discharged through outlet 30 into storage tank 32.

Reclamation of the detergent solution and recovery of the oleaginous substances removed from the swarf can be effected in storage tank 32, if desired. To this end cooling or heating coils 33 can be provided for adjusting the temperature of the liquid product in tank 32 so as to effect phase separation. For example, by heating the obtained liquid product to an elevated temperature, i.e., to about 20° F. above ambient temperature, the oleaginous phase separates out. Preferably the obtained liquid produuct is heated about 40° F. to about 80° F. above ambient to effect phase separation.

The quantity of liquid in the storage tank 32 is maintained at a substantially constant level 34 by means of an overflow weir of skimmer 36. Due to the difference in the specific gravities of the oleaginous phase and the aqueous phase that separate out, the oleaginous phase will rise to surface 34 and is removed by means of the skimmer 36. The oleaginous phase can then be further processed in centrifuge 38 to remove any remaining traces of aqueous phase, i.e., detergent solution, that may be present. The oleaginous phase is then discharged from the centrifuge and collected in a suitable receptacle 40 for subsequent use. The detergent solution collected in the centrifuge may be returned to storage tank 32 and recirculated.

Washed swarf is advanced by conveyor 8 from wash station 14 to optional rinse station 16 and is there subjected to a spray rinse F comprising clean water or the like discharged through a plurality of spray heads 42 for removing any remaining detergent solution and/or emulsified cutting fluid residues.

The rinse water together with any entrained substances is drawn through the mesh surface of conveyor 8 concurrently with an air stream and collected in second vacuum chamber 26, from which the obtained liquid product is discharged through outlet 44 into rinse storage tank 46. Again, due to the difference in the respective specific gravities, any oleaginous material present will rise to the surface of the fluid in the rinse tank and can be recovered as overflow therefrom. The liquid level in tank 46 is maintained at a substantially constant level 48 by means of spill-way 50 which is in communication with tank 32 and which permits the collection of all oleaginous materials as the upper layer of tank 32. The liquid remaining in tank 46 is substantially clean rinse water or may contain some detergent. Make-up water may be added through inlet 52 if needed for maintaining level 48 in tank 46 and level 34 in tank 32.

As the cleansed swarf C is advanced by conveyor 8 from rinse station 16 to drying station 18, the remaining rinse water on the surface of the swarf particles is removed by evaporation or by an air stream passing therethrough to dry the swarf particles. Where desired, evaporation may be also induced by radiant heat or by an air stream at a temperature above ambient, e.g., by passing a stream of warm, dry air over the swarf. Preferably the upper, inlet portion of the vacuum chamber 26 is in communication with the mesh surface of conveyor 8 in the area comprising drying section 18, so that any residual water which drains through the mesh, or is entrained in the air stream passing through the swarf bed, is collected in the chamber and discharged through outlet 44 into rinse tank 46.

The cleansed, dry swarf is then discharged at conveyor discharge end 20 and is collected in a suitable receptacle 22 for subsequent utilization.

In the preferred embodiment, the aqueous detergent solution is provided to crusher 10 and wash station 14 by a recirculating system which includes tank 32 in closed circuit with pump 54, detergent solution outlet 56 adjacent crusher 10 for mixing swarf to be cleaned and a detergent solution, and spray heads 28 of the wash station. In use, the detergent solution is pumped from storage tank 32 through conduit 57 and is discharged at outlet 56 and spray heads 28 as schematically illustrated in the FIGURE.

Likewise, the rinse water is provided to rinse station 16 by a recirculating system including storage tank 46 in closed circuit with pump 60 and spray heads 42 of the rinse station 16. The rinse water is pumped from tank 46 through conduit 61 and is discharged at spray heads 42 as diagrammatically shown in the FIGURE.

The foregoing disclosure is intended to be illustrative and is not to be taken as limiting. Other variations and modifications of the disclosed swarf washing system are possible without departing from the spirit and scope of the invention and will readily present themselves to one skilled in the art.

I claim:

1. A method for removing cutting fluid residues from particulate swarf which comprises the steps of contacting said particulate swarf with an aqueous non-ionic detergent solution having a detergent concentration of about 1 to about 5 percent by weight to form an admixture of said swarf and said detergent solution containing detergent in an amount sufficient to emulsify said residues, said detergent solution being alkaline and containing a water-soluble detergent and an oil-soluble detergent;

forming a bed of said particulate swarf bearing the emulsified residues;

removing the emulsified residues from said particulate swarf by passing through the formed bed a fluid stream at a rate sufficient to entrain therein the emulsified residues and to cleanse the particulate swarf; and recovering the cleansed particulate swarf.

2. The method in accordance with claim 1 wherein the emulsified residues are removed by vacuum filtration of the particulate swarf.

3. The method in accordance with claim 1 wherein the fluid stream is an air stream and the emulsified residues are removed by passing the air stream through said bed.

4. The method in accordance with claim 1 wherein the fluid stream is a water stream and the emulsified residues are removed by passing the water stream through said bed.

5. The method in accordance with claim 1 wherein the bed is formed by providing a substantially horizontal, moving foraminous belt and depositing said admixture of swarf and detergent solution on said belt, and wherein the fluid stream for removing the emulsified residues is an air stream generated by providing a source of subatmospheric pressure immediately below said belt and drawing air through said bed and said belt.

6. The method in accordance with claim 5 wherein additionally a liquid is sprayed onto said bed and passes through the thickness of said bed while the air stream is drawn therethrough concurrently therewith.

7. The method in accordance with claim 6 wherein the liquid passing through the bed is collected as a liquid product; wherein the liquid product is separated into an oleaginous phase and an aqueous phase; wherein the oleaginous phase is recovered, and wherein the aqueous phase is recycled for spraying onto said bed.

8. The method in accordance with claim 1 wherein the removed emulsified residues are recovered as a liquid product; and wherein the liquid product is separated into an aqueous phase and an oleaginous phase.

9. The method in accordance with claim 8 wherein the liquid product is separated by lowering the pH of the liquid product.

10. The method in accordance with claim 8 wherein aqueous components of the separated oleaginous phase are removed by centrifuging.

11. The method in accordance with claim 8 wherein the liquid product is separated into an aqueous phase and an oleaginous phase by adjusting the temperature thereof.

12. The method in accordance with claim 1 wherein the cleansed particulate swarf is dried by passing an air stream therethrough.

13. The method in accordance with claim 12 wherein the air stream is at a temperature above ambient.

14. The method in accordance with claim 1 wherein the cleansed particulate swarf is dried by subjecting the swarf to radiant heat.

15. A method for removing cutting fluid residues from particulate swarf which comprises the steps of contacting said particulate swarf with a first portion of an aqueous non-ionic detergent solution to form an admixture of said swarf and said detergent solution containing detergent in an amount sufficient to emulsify said residues, said detergent solution being alkaline and containing a water-soluble detergent and an oil-soluble detergent;

forming a bed of said particulate swarf bearing the emulsified residues by providing a substantially horizontal, moving foraminous belt and depositing said admixture of swarf and detergent solution on said belt;

spraying onto said bed a second portion of said detergent solution as a first liquid and then spraying onto said bed rinse water as a second liquid;

removing the emulsified residues from said particulate swarf by passing through said bed an air stream generated by providing a source of subatmospheric pressure immediately below said belt and drawing air through said bed and said belt;

said aqueous solution and said rinse water being sprayed onto said bed so as to pass through the thickness of said bed while the air stream is drawn through said bed concurrently therewith; and recovering the cleansed particulate swarf from said belt.

16. The method in accordance with claim 15 including the further steps of collecting the removed emulsified residues together with said first liquid as a first liquid product containing said detergent solution and together with said second liquid as a second liquid product containing said rinse water, separating each of the liquid products into an oleaginous phase and an aqueous phase; recovering the oleaginous phases; and recycling the aqueous phase of the first liquid product as said detergent solution and the aqueous phase of the second liquid product as said rinse water.

17. A method for removing cutting fluid residues from particulate swarf which comprises the steps of contacting said particulate swarf with an aqueous, alkaline detergent solution to form an admixture of said swarf and said detergent solution containing detergent in an amount sufficient to emulsify said residues;

forming a bed of said particulate swarf bearing the emulsified residues;

removing the emulsified residues from said particulate swarf by passing through the formed bed a fluid stream at a rate sufficient to entrain therein the emulsified residues and to cleanse the particulate swarf; and recovering the cleansed particulate swarf;

said detergent solution containing a water-soluble detergent and an oil-soluble detergent, and said detergents being selected from the group consisting of an alkoxylated aliphatic alcohol and an alkoxylated aliphatic polyol.

18. A method for removing cutting fluid residues from particulate swarf which comprises the steps of contacting said particulate swarf with an aqueous non-ionic detergent solution having a detergent concentration of about 1 to about 5 percent by weight to form an admixture of said swarf and said detergent solution containing detergent in an amount sufficient to emulsify said residues;

forming a bed of said particulate swarf bearing the emulsified residues;

removing the emulsified residues from said particulate swarf by passing through the formed bed a fluid stream at a rate sufficient to entrain therein the emulsified residues and to cleanse the particulate swarf; and recovering the cleansed particulate swarf; the aqueous detergent solution being alkaline and containing a water-soluble detergent which is an alkoxylated alkyl phenol and an oil-soluble detergent which is an alkoxylated alkyl phenol.

19. The method in accordance with claim 18 wherein the alkoxylated alkyl phenol is an ethoxylated nonyl phenol.

20. A method for removing cutting fluid residues from particulate swarf which comprises the steps of contacting said particulate swarf with an aqueous detergent solution to form an admixture of said swarf and said detergent solution containing detergent in an amount sufficient to emulsify said residues;

forming a bed of said particulate swarf bearing the emulsified residues;

removing the emulsified residues from said particulate swarf by passing through the formed bed a fluid stream at a rate sufficient to entrain therein the emulsified residues and to cleanse the particulate swarf; and recovering the cleansed particulate swarf;

the aqueous detergent solution being alkaline and containing an ethoxylated nonyl phenol containing about 15 moles of ethylene oxide per mole of nonyl phenol and an ethoxylated nonyl phenol containing about 1.5 moles of ethylene oxide per mole of nonyl phenol.

21. A method for removing cutting fluid residues from particulate swarf which comprises the steps of contacting said particulate swarf with an aqueous detergent solution to form an admixture of said swarf and said detergent solution containing detergent in an amount sufficient to emulsify said residues;

forming a bed of said particulate swarf bearing the emulsified residues;

removing the emulsified residues from said particulate swarf by passing through the formed bed a fluid stream at a rate sufficient to entrain therein the emulsified residues and to cleanse the particulate swarf; and recovering the cleansed particulate swarf;

the aqueous detergent solution containing dissolved therein, in an amount of about 1 to about 5 ounces per gallon of water, a composition comprising about 1 to about 45 parts by weight sodium carbonate, about 1 to about 45 parts by weight sodium meta-silicate, about 1 to about 8 parts by weight sodium gluconate, and about 1 to about 5 parts by weight of a mixture comprising an ethoxylated nonyl phenol containing about 15 moles of ethylene oxide per mole of nonyl phenol and an ethoxylated nonyl phenol containing about 1.5 moles of ethylene oxide per mole of nonyl phenol.

* * * * *